US009360173B2

(12) United States Patent
Takeuchi

(10) Patent No.: US 9,360,173 B2
(45) Date of Patent: Jun. 7, 2016

(54) LED BULB AND ILLUMINATION DEVICE

(71) Applicant: Osamu Takeuchi, Takaoka (JP)

(72) Inventor: Osamu Takeuchi, Takaoka (JP)

(73) Assignee: Osamu Takeuchi, Takaoka-Shi, Toyama (JP)

( * ) Notice: Subject to any disclaimer, the term of this patent is extended or adjusted under 35 U.S.C. 154(b) by 117 days.

(21) Appl. No.: 14/293,174

(22) PCT Filed: Nov. 13, 2012

(86) PCT No.: PCT/JP2012/079365
§ 371 (c)(1),
(2) Date: Jun. 2, 2014

(87) PCT Pub. No.: WO2013/084674
PCT Pub. Date: Jun. 13, 2013

(65) Prior Publication Data

US 2014/0321125 A1 Oct. 30, 2014

(30) Foreign Application Priority Data

Dec. 9, 2011 (JP) ..... 2011-270383
Jun. 7, 2012 (JP) ..... 2012-129518
Jul. 6, 2012 (JP) ..... 2012-152015

(51) Int. Cl.

| | |
|---|---|
| ***F21V 7/00*** | (2006.01) |
| ***F21K 99/00*** | (2016.01) |
| ***F21V 3/04*** | (2006.01) |
| ***F21V 29/00*** | (2015.01) |
| ***F21V 29/506*** | (2015.01) |

(Continued)

(52) U.S. Cl.
CPC ..... *F21K 9/50* (2013.01); *F21V 3/0472* (2013.01); *F21V 7/0016* (2013.01); *F21V 29/004* (2013.01); *F21V 29/506* (2015.01); *F21V 29/763* (2015.01); *F21V 29/767* (2015.01); *F21K 9/13* (2013.01); *F21V 3/02* (2013.01); *F21V 7/0066* (2013.01); *F21V 7/041* (2013.01); *F21V 11/14* (2013.01); *F21V 15/01* (2013.01); *F21V 17/12* (2013.01); *F21V 31/005* (2013.01); *F21Y 2101/02* (2013.01); *F21Y 2105/001* (2013.01)

(58) Field of Classification Search
CPC ..... F21K 9/13; F21K 9/50; F21V 7/0016; F21V 11/14; F21V 3/0472; F21V 7/0066; F21V 7/041; F21V 17/12; F21V 15/01; F21V 29/004; F21V 31/005; F21V 29/506; F21V 29/763; F21V 29/767; F21Y 2101/02; F21Y 2105/001; F21Y 3/02
USPC ..... 362/296.01
See application file for complete search history.

(56) References Cited

U.S. PATENT DOCUMENTS

| | | | | |
|---|---|---|---|---|
| 8,628,220 | B2 | 1/2014 | Boonekamp et al. | |
| 2005/0230691 | A1* | 10/2005 | Amiotti | H01L 33/44 257/79 |
| 2011/0267836 | A1* | 11/2011 | Boonekamp | F21K 9/52 362/555 |

FOREIGN PATENT DOCUMENTS

| | | | |
|---|---|---|---|
| JP | S64-27805 | U | 2/1989 |
| JP | H06-28907 | A | 2/1994 |
| JP | H11-213725 | A | 8/1999 |
| JP | 2003-31025 | A | 1/2003 |
| JP | 2011-009021 | A | 1/2011 |

*Primary Examiner* — Bao Q Truong
*Assistant Examiner* — Hana Featherly
(74) *Attorney, Agent, or Firm* — Manabu Kanesaka

(57) ABSTRACT

An illumination tool has an LED light source; and a light reflecting part which is provided at a front of the LED light source. The light reflecting part is given a slant so as to approach the LED light source toward a center.

12 Claims, 18 Drawing Sheets

(51) Int. Cl.

| | |
|---|---|
| ***F21V 29/76*** | (2015.01) |
| *F21V 11/14* | (2006.01) |
| *F21Y 101/02* | (2006.01) |
| *F21Y 105/00* | (2016.01) |
| *F21V 3/02* | (2006.01) |
| *F21V 7/04* | (2006.01) |
| *F21V 17/12* | (2006.01) |
| *F21V 15/01* | (2006.01) |
| *F21V 31/00* | (2006.01) |

(56) References Cited

FOREIGN PATENT DOCUMENTS

| | | | |
|---|---|---|---|
| JP | 2011-82132 | A | 4/2011 |
| JP | 3169310 | U | 7/2011 |
| JP | 2012-514843 | A | 6/2012 |
| JP | 2012-160418 | A | 8/2012 |
| WO | 2010/079436 | A1 | 7/2010 |

* cited by examiner

LED BULB AND ILLUMINATION DEVICE

RELATED APPLICATIONS

The present application is National Phase of International Application No. PCT/JP2012/079365 filed Nov. 13, 2012, and claims priority from Japanese Application Nos. 2011-270383 filed Dec. 9, 2011, 2012-129518 filed Jun. 7, 2012, and 2012-152015 filed Jul. 6, 2012.

TECHNICAL FIELD

The present invention relates to an illumination tool which utilizes an LED light source.

BACKGROUND ART

In recent years, LED bulbs which can take the place of incandescent bulbs have been widely spreading. LED bulbs, for example as shown in PLT 1, are provided with roughly conical shape cases made of aluminum alloy continuing from caps which are connected to sockets, have boards on which a large number of LED chips are arranged and have electrical circuits inside the cases, and have glass globes fit into the open ends of the cases.

Since LED bulbs have electrical circuits embedded in their cases, when turned on, the surfaces of the cases become extremely high in temperature resulting in the danger of children etc. being burned by touching them or causing fires if set near a flammable item. Further, if water enters from the joints of the cases and globes, the LED boards and electrical circuits break down, so use outdoors or in bathrooms or other locations which are exposed to water is not possible. Further, LED bulbs can only emit light to the front sides due to their utilization of LEDs and cannot light up the surroundings of the bulbs as a whole like with incandescent bulbs.

CITATION LIST

Patent Literature

PLT 1: Japanese Patent Publication No. 2011-82132A

SUMMARY OF INVENTION

Technical Problem

The present invention was made in consideration of the actual situation which was explained above and has as its object the provision of an illumination tool which can utilize an LED light source while lighting up the surroundings as a whole. Further, the present invention has as its object the provision of an illumination tool which can prevent burns and fires and can be used even outdoors or at other locations which are exposed to water.

Solution to Problem

To achieve the above object, the illumination tool of the aspect of the invention according to the first aspect is characterized by being provided with an LED light source and a light reflecting part which is provided at the front of the LED light source, where the light reflecting part is given a slant so as to approach the LED light source more the more toward the center.

The illumination tool of the aspect of the invention according to the second aspect is characterized in that, in addition to the configuration of the aspect of the invention according to the first aspect, when a radius of a case where the LED light source is set is "r", a distance from the LED light source to the light reflecting part is "h", and a gradient of the light reflecting part is "$\alpha$", a relationship of $r/h \approx \tan 2\alpha$ is satisfied.

The illumination tool of the aspect of the invention according to the third aspect is characterized in that it is provided with a main body of a closed bottom tubular shape which has a light transmitting ability and with a lid which closes an opening part of the main body and where an LED bulb is housed in its inside.

The illumination tool of the aspect of the invention according to the fourth aspect is characterized in that, in addition to the configuration of the aspect of the invention according to the third aspect, the lid has a double structure of an inner lid and an outer lid and a desiccant is provided in the space between the inner lid and outer lid.

The illumination tool of the aspect of the invention according to the fifth aspect is characterized in that, in addition to the configuration of the aspect of the invention according to the third or fourth aspect, the main body is processed so as to make the light which the LED bulb emits disperse to the surroundings.

The illumination tool of the aspect of the invention according to the fifth aspect is characterized in that, in addition to the configuration of the aspect of the invention according to the third, fourth, or fifth aspect, the main body or lid is provided with a heat radiating plate which bulges out to an outer circumferential side.

The illumination tool of the aspect of the invention according to the seventh aspect is characterized in that, in addition to the configuration of the aspect of the invention according to the sixth aspect, a heat radiating plate is formed integrally with the main body and wherein a pattern is cut into the heat radiating plate.

The illumination tool of the aspect of the invention according to the eighth aspect is characterized in that, in addition to the configuration of the aspect of the invention according to the third, fourth, fifth, sixth, or seventh aspect, a side wall of the main body has a taper part with a diameter which becomes smaller the more toward a bottom part side.

The illumination tool of the aspect of the invention according to the ninth aspect is characterized in that, in addition to the configuration of the aspect of the invention according to the third, fourth, fifth, sixth, seventh, or eighth aspect, wherein a bottom part of the main by has a light reflecting part which reflects light of the LED bulb and wherein the light reflecting part is given a slant so as to approach the LED light source more the more toward the center.

The illumination tool of the aspect of the invention according to the tenth aspect is characterized in that, in addition to the configuration of the aspect of the invention according to ninth aspect, when the LED light source is set is "r", a distance from the LED light source to the light reflecting part is "h", and a gradient of the light reflecting part is "$\alpha$", a relationship of $r/h \approx \tan 2\alpha$ is satisfied.

The illumination tool of the aspect of the invention according to the eleventh aspect is characterized in that, in addition to the configuration of the aspect of the invention according to first or ninth aspect, the light reflecting part is arranged with a center offset from a center of the LED light source.

The illumination tool of the aspect of the invention according to the twelfth aspect is characterized in that, in addition to the configuration of the aspect of the invention according to the eleventh aspect, when a distance from the LED light source to the edge of the case where the LED light source is set is r', a distance from the LED light source to the light reflecting part is h', and a gradient of the light reflecting part is "α", a relationship of r'/h'≈ tan 2α is satisfied.

The illumination tool of the aspect of the invention according to the thirteenth aspect is characterized in that, in addition to the configuration of the aspect of the invention according to the first, second, ninth, tenth, eleventh, or twelfth aspect, a light reflecting part is formed by attaching a metal foil or high light blocking paint on a glass surface.

The illumination tool of the aspect of the invention according to the fourteenth aspect is characterized in that, in addition to the configuration of the aspect of the invention according to the thirteenth aspect, a pattern is formed by a metal foil or high light blocking paint.

Advantageous Effects of Invention

The illumination tool of the aspect of the invention according to the first aspect is provided with a light reflecting part at the front of an LED light source, where the light reflecting part is given a slant so as to approach the LED light source more the more toward the center, so light which is emitted from the LED light source toward the front surface can be reflected at the light reflecting part and light can be made to be emitted to a back surface side of the case at which the LED light source is set (downward when set facing upward), therefore the beam angle becomes greater and the surroundings can be lighted up as a whole.

The illumination tool of the aspect of the invention according to the second aspect is characterized in that when a radius of a case where the LED light source is set is "r", a distance from the LED light source to the light reflecting part is "h", and a gradient of the light reflecting part is "α", a relationship of r/h≈ tan 2α is satisfied, so light which is emitted from the LED light source can be reflected so as to be emitted to the outside of the case at which the LED light source is set, therefore the loss of light energy can be reduced to a minimum and the beam angle can be made maximum.

The illumination tool of the aspect of the invention according to the third aspect is characterized in that it is provided with a main body of a closed bottom tubular shape which has a light transmitting ability and with a lid which closes an opening part of the main body and an LED bulb is housed in its inside, so even if the case of the LED bulb is heated to a high temperature, the main body and the lid do not become that hot and children getting burned due to touching it or fires being started can be prevented. Further, the LED bulb can be held inside of the present illumination tool and the LED bulb never becomes wet, so use is possible even outdoors or other locations which are exposed to water.

The illumination tool of the aspect of the invention according to the fourth aspect is characterized in that the lid has a double structure of an inner lid and an outer lid and a desiccant is provided in the space between the inner lid and outer lid, so the desiccant can absorb the moisture of the holding space of the LED bulb and faults in the LED bulb can be prevented. Further, the desiccant becomes dried out due to the heat which the LED bulb emits, so the effect of absorption of the moisture at the inside can be maintained for a long period of time.

The illumination tool of the aspect of the invention according to the fifth aspect is characterized in that the main body is processed so as to make the light which the LED bulb emits disperse to the surroundings, so the surroundings of the illumination tool as a whole can be lighted up.

The illumination tool of the aspect of the invention according to the sixth aspect is characterized in that the main body or lid is provided with a heat radiating plate which bulges out to an outer circumferential side, so radiation of heat is promoted and the main body or lid can be prevented from becoming hot.

The illumination tool of the aspect of the invention according to the seventh aspect is characterized in that a heat radiating plate is formed integrally with the main by and a pattern is cut into the heat radiating plate, so radiation of heat by the heat radiating plate is promoted more and the pattern which is cut into the heat radiating plate is highlighted due to the light, so becomes more attractive.

The illumination tool of the aspect of the invention according to the eighth aspect is characterized in that a side wall of the main body has a taper part with a diameter which becomes smaller the more toward a bottom part side, so the light which is emitted from the LED bulb is refracted and reflected at the taper part and therefore the surroundings become brighter.

The illumination tool of the aspect of the invention according to the ninth aspect is characterized in that a bottom part of the main body has a light reflecting part which reflects light of the LED bulb and the light reflecting part is given a slant so as to approach the LED light source more the more toward the center, so the light which is emitted from the LED light source toward the front is reflected at the light reflecting part, light can be emitted to the back surface side of the case at which the LED light source is provided (downward when the LED bulb is set upward), and the beam angle can be enlarged.

The illumination tool of the aspect of the invention according to the tenth aspect is characterized in that when the LED light source is set is "r", a distance from the LED light source to the light reflecting part is "h", and a gradient of the light reflecting part is "α", a relationship of r/h≈ tan 2α is satisfied, so the light which is emitted from the LED light source is reflected so as to exit to the outside of the case, therefore the loss of the light energy is greatly reduced and the beam angle can be made maximum.

The illumination tool of the aspect of the invention according to the eleventh aspect is characterized in that the light reflecting part is arranged with a center offset from a center of the LED light source, so light is concentratedly reflected to a predetermined range in the surroundings and the required locations can be efficiently lighted up.

The illumination tool of the aspect of the invention according to the twelfth aspect is characterized in that when a distance from the LED light source to the edge of the case where the LED light source is set is r', a distance from the LED light source to the light reflecting part is h', and a gradient of the light reflecting part is "α", a relationship of r'/h'≈ tan 2α is satisfied, so light which is emitted from the LED light source is reflected so as to exit to outside of the case, therefore the loss of the light energy is greatly reduced and the light can be effectively utilized even if an LED light source with little amount of light.

The illumination tool of the aspect of the invention according to the thirteenth aspect is characterized in that a light reflecting part is formed by attaching a metal foil or high light blocking paint on a glass surface, so the light reflecting part reflects light well like a mirror. Further, when providing the light reflecting part at the bottom part of a main body made of glass, the main body is sealed by closing the opening part by the lid, so the inside is kept from becoming dirty and the mirror effect can be maintained over a long period of time.

The illumination tool of the aspect of the invention according to the fourteenth aspect is characterized in that a pattern is formed by a metal foil or high light blocking paint, so it is possible to enjoy the pattern as a design image when turned off. Light is transmitted from the part of the bottom where metal foil or high light blocking paint is attached, so the front surface side of the LED bulb can also be lighted up and the pattern can be projected.

DESCRIPTION OF EMBODIMENTS

Figure 1B:
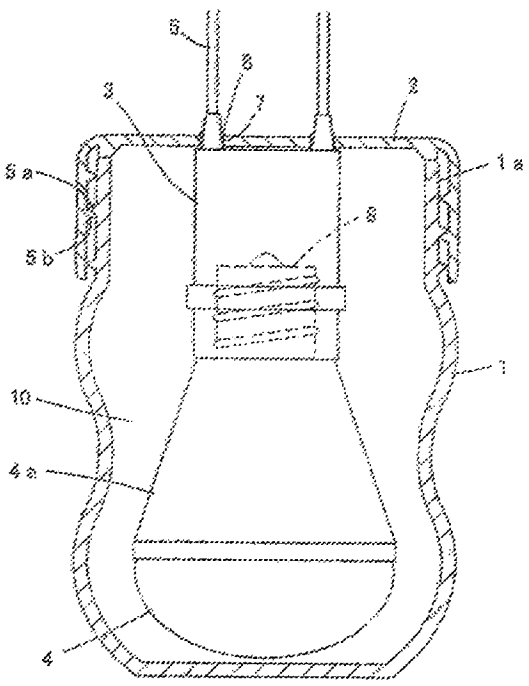
FIG. 1(*a*) is a front view which shows a first embodiment of an illumination tool of the present invention, while FIG. 1(*b*) is a longitudinal cross-sectional view of the same illumination tool.
Figure 1A:
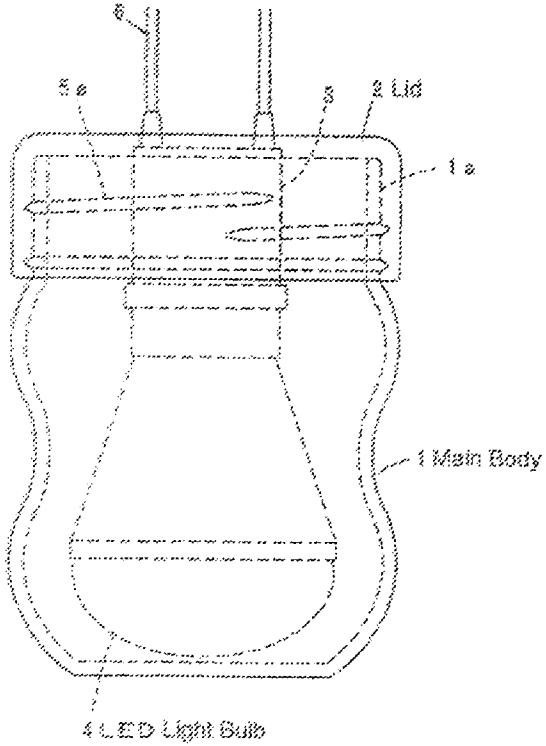
Figure 2:
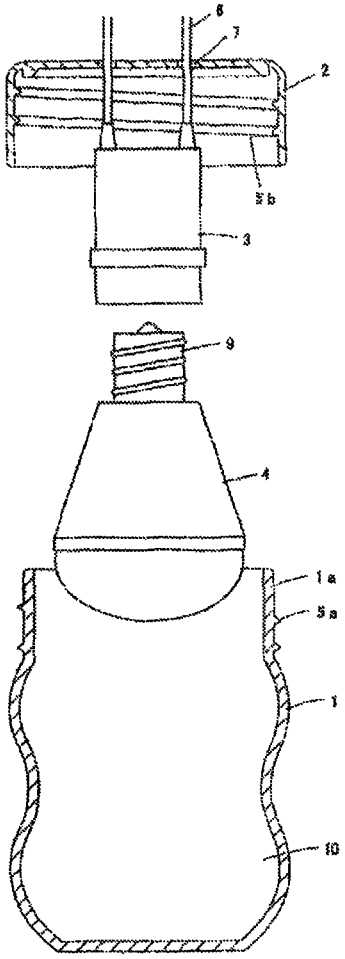
FIG. 2 is a longitudinal cross-sectional view which shows the same illumination tool in a disassembled state.

Below, embodiments of the present invention will be explained based on the drawings. FIGS. 1(*a*), 1(*b*) and 2 show a first embodiment of the illumination tool of the present invention. The illumination tool is comprised of a main body 1 of a closed bottom tube shape which is formed by transparent glass and a plastic lid 2 which closes the opening part 1*a* which is formed at the top of the main body 1 and houses a socket 3 and LED bulb 4 at the inside. The main body 1 has an inside diameter of the opening part 1*a* formed larger than the maximum outside diameter of the LED bulb 4. In the state with the lid 2 detached, the LED bulb 4 is placed inside the main body 1 through the opening part 1*a*. The lid 2 is attached to the opening part 1*a* of the main body 1 by screws 5*a* and 5*b* in a detachable manner and closes the opening part 1*a* of the main body 1 to seal it so that water does not enter the inside. The lid 2 is formed with a hole 7 through which a wire 6 which extends from the socket 3 is passed. The hole 7 is sealed by a seal material 8 after passing the wire 6 through it. The LED bulb 4 is a commercially available one of 100V, 6.0 W and is attached by screwing a cap 9 into the socket 3.

The illumination tool houses the LED bulb 4 inside it in a sealed state. There is a space 10 around the LED bulb 4, so even if the case 4*a* of the LED bulb 4 heats up to a high temperature, the main body 1 and the lid 2 do not become that hot and children can be prevented from being burned by touching them or fires can be started. Further, the LED bulb 4 is also housed inside the illumination tool, so the LED bulb 4 never becomes wet. Therefore, the device can be used even outdoors or at other locations which are exposed to water. Further, the lid 2 can be freely opened and closed. By detaching the lid 2, the LED bulb 4 can be taken out of and placed in the main body 1 from the opening part 1*a*, so the LED bulb 4 can be easily attached or replaced. The illumination tool is simple in structure, so can be inexpensively produced. For example, it can be widely used without regard as to the location such as outdoors at parks or roadsides, in the gardens of houses or approaches to their front doors, etc.

Figure 3B:
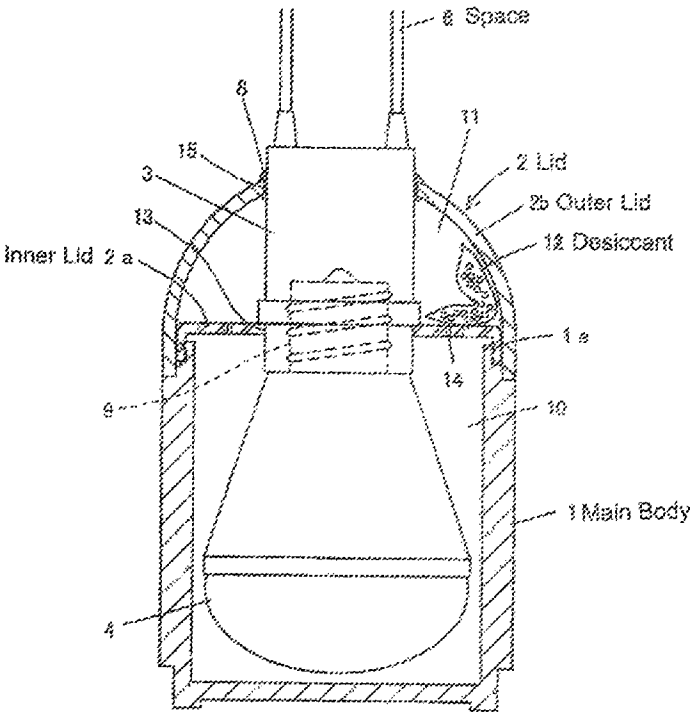
FIG. 3(*a*) is a front view which shows a second embodiment of an illumination tool of the present invention, while FIG. 3(*b*) is a longitudinal cross-sectional view of the illumination tool.
Figure 3A:
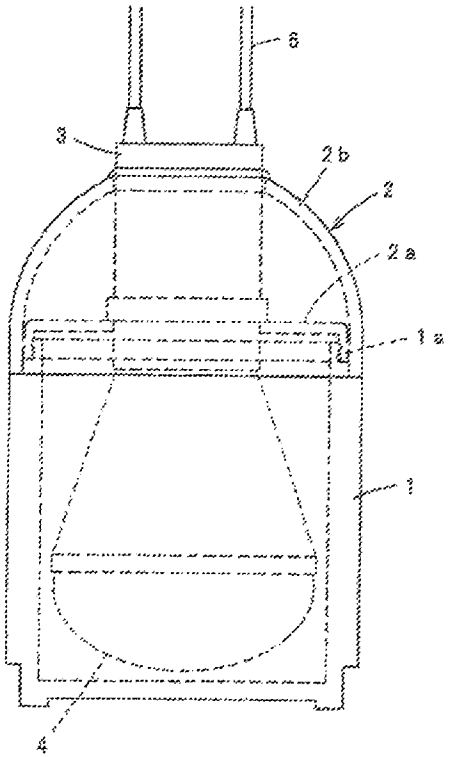
Figure 4:
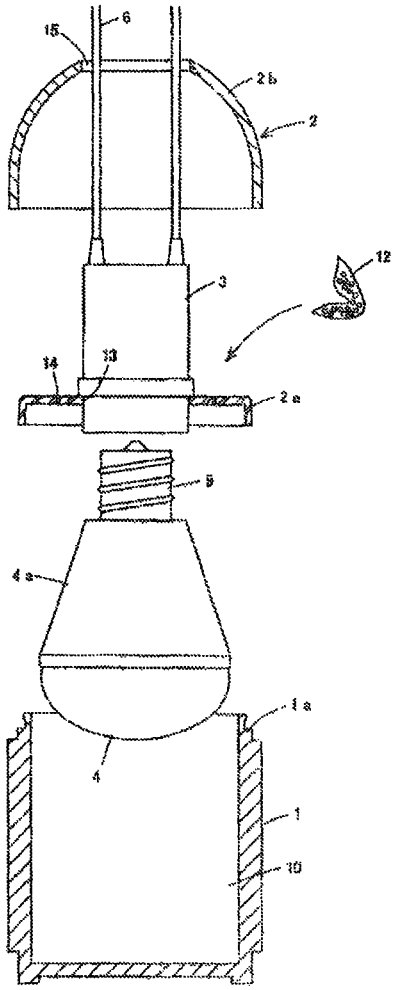
FIG. 4 is a longitudinal cross-sectional view of the illumination tool in a disassembled state.

FIGS. 3(*a*), 3(*b*) and 4 show a second embodiment of the illumination tool of the present invention. In the illumination tool, the lid 2 has a double structure of an inner lid 2*a* and an outer lid 2*b*. In a space 11 between the inner lid 2*a* and the outer lid 2*b*, a desiccant 12 is placed. The main body 1 is formed by a transparent plastic. The inner lid 2*a* and outer lid 2*b* are fit and attached at the open part 1*a* of the main body 1. The inner lid 2*a* holds the socket 3 inserted in a hole 13 which is provided at its center. Air holes 14 are formed around it. The outer lid 2*b* has an insertion hole 15 for the socket 3 and is sealed around the insertion hole by a seal material 8.

As stated above, in the illumination tool, the lid 2 has a double structure of an inner lid 2*a* and an outer lid 2*b* and, in the space 11 between the inner lid 2*a* and the outer lid 2*b*, a desiccant 12 is placed. The desiccant 12 absorbs the moisture of the space 10 inside of the main body 1 which holds the LED bulb 4 and can prevent the LED bulb 4 from being damaged. Further, the desiccant 12 is dried by the heat which the LED bulb 4 emits, so the effect of absorbing the moisture of the insides can be maintained over a long period of time. By forming the main body 1 by plastic, it becomes less hot than when formed by glass.

Figure 5:
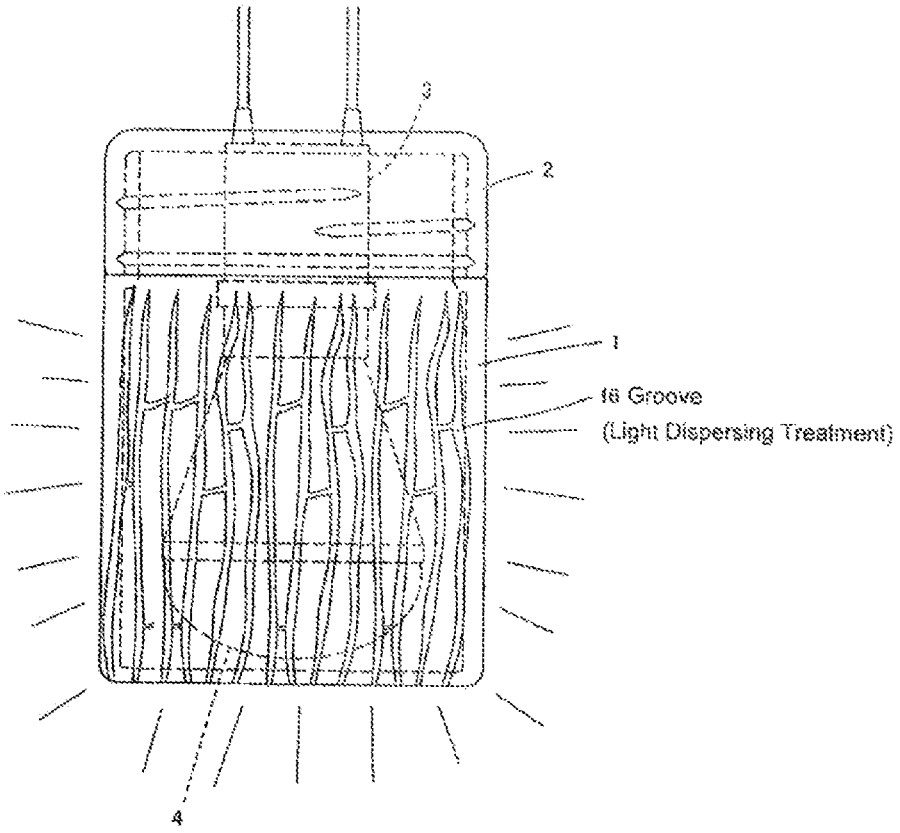
FIG. 5 is a front view which shows an example of the application of the illumination tool of the present invention.

FIG. 5 shows an example of application of the illumination tool of the present invention. The illumination tool has a large number of grooves 16 cut into the surface of the main body 1. Due to these grooves 16, the light which is emitted from the LED bulb 4 is dispersed and the surroundings of the main body 1 can be lighted up as a whole. The grooves 16 which are provided at the main body 1 can be provided in any manner. For example, they can be provided in geometric patterns. The grooves 16 can also be cut in a crystal like manner. Further, instead of cutting the grooves 16, the surface of the main body 1 can be roughened to give a frosted glass appearance. In that case, the main body 1 as a whole is lighted up in a blurry manner.

Figure 6B:
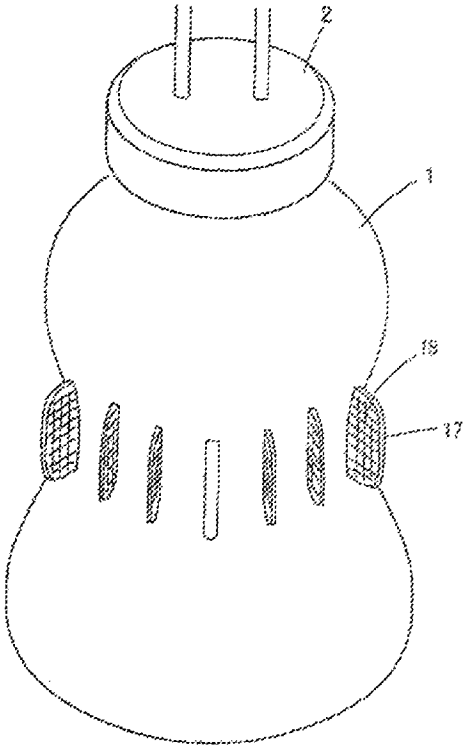
FIGS. 6(*a*), 6(*b*) are perspective views showing another example of the application of the illumination tool of the present invention.
Figure 6A:
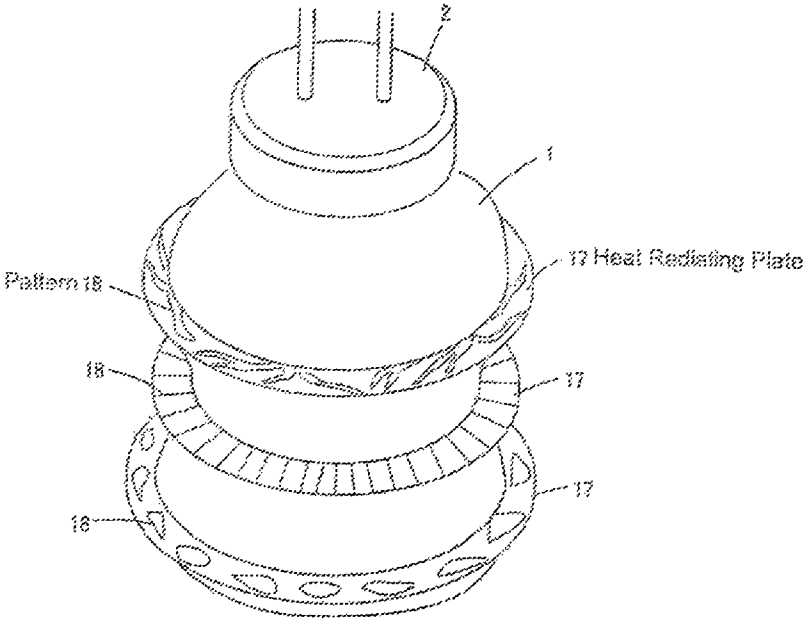

FIGS. 6(*a*), 6(*b*) show another example of application of the illumination tool of the present invention. The device of FIG. 6(*a*) has a plurality of ring shaped heat radiating plates 17 at the surface of the main body 1. These are formed integrally with the main body 1 so as to stick out to the outer circumference side of the main body 1. The heat radiating plates 17 have patterns 18 which are comprised or grooves or holes cut into them. By providing the heat radiating plates 17 at the main body 1 in this way, radiation of heat from the main body 1 is promoted and the main body 1 can be prevented from becoming hot more reliably. Further, by cutting patterns 18 in the heat radiating plates 17, the radiation of heat by the heat radiating plates 17 is promoted even more. The patterns 18 which are cut in the heat radiating plates 17 are highlighted by the light, so become more attractive. The heat radiating plates 17, as shown in FIG. 6(*b*), can also be provided dispersed in a radial manner around the main body 1. Further, the heat radiating plates 17 can be provided at the lid 2.

Figure 7A:
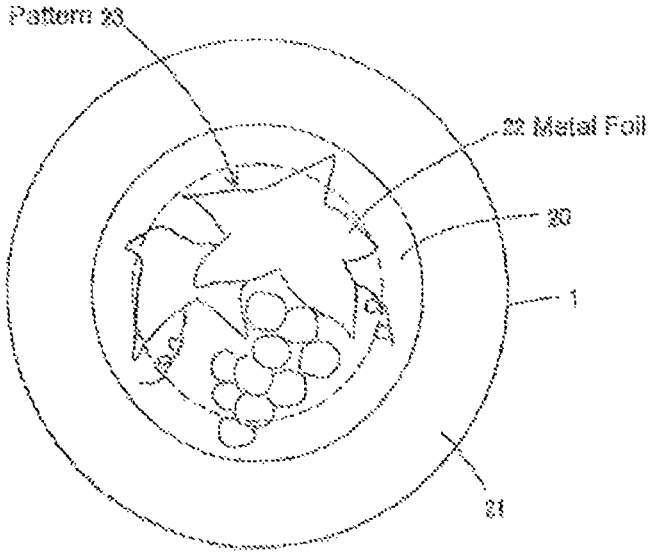
FIG. 7(*a*) is a plan view which shows a third embodiment of an illumination tool of the present invention, while FIG. 7(*b*) is a front view of the illumination tool.
Figure 7B:
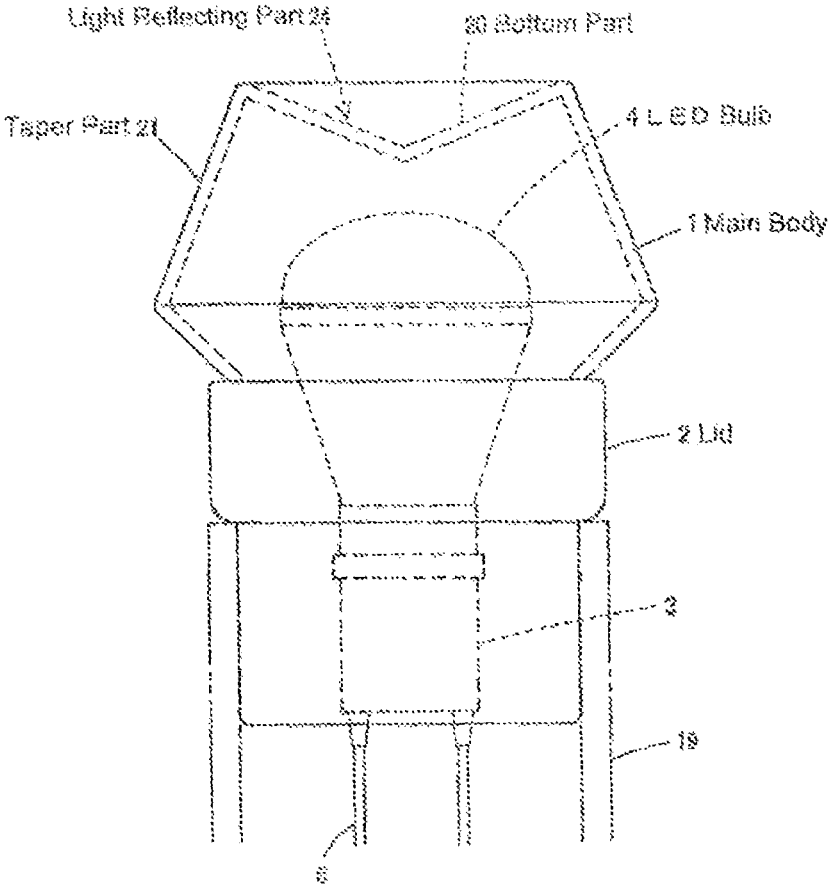
Figure 8:
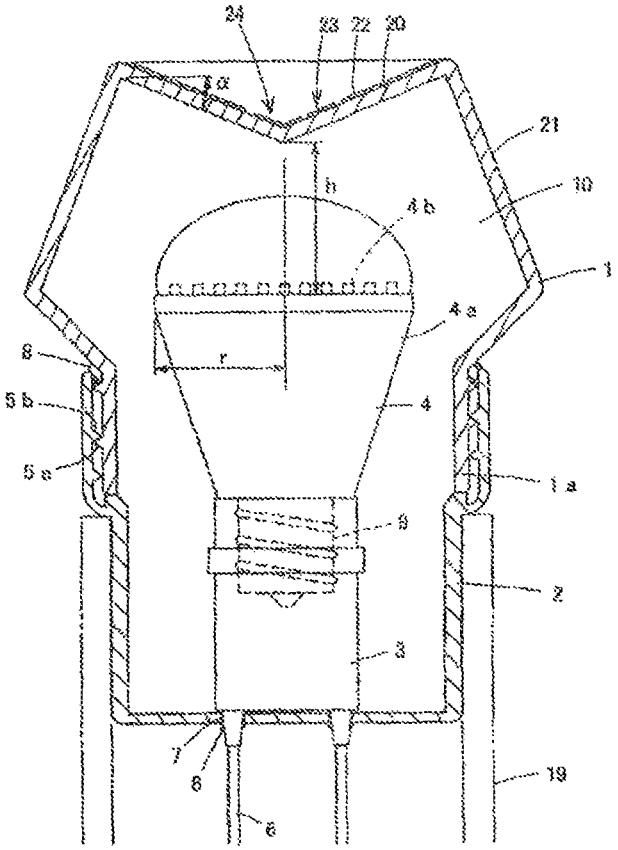
FIG. 8 is a longitudinal cross-sectional view of the illumination tool.

FIGS. 7(*a*), 7(*b*) and 8 show a third embodiment of the illumination tool of the present invention. The illumination tool is provided with a main body 1 made of glass which is set on a columnar support 19 and is opened at the bottom and a lid 2 made of plastic which closes the opening part 1*a* of the main body 1. The LED bulb 4 is set facing upward at the inside.

The main body 1 has a taper part 21 at the side walls with a diameter which becomes smaller the more toward the bottom part 20 side. Due to this, the light which is emitted from the LED bulb 4 is refracted and reflected at and passes through the taper part 21, so the surroundings become brighter. The bottom part 20 of the main body 1 is recessed inward in a conical shape so as to become closer to the light source 4*b* of the LED bulb the further toward the center. At the surface of the bottom part 20, as shown in FIG. 7(*a*), metal foil or a high light blocking paint 22 is attached or coated so as to form patterns 23. The parts of the bottom part 20 at which the metal foil or high light blocking paint 22 is provided become like a mirror and form the light reflecting part 24. The upward directed light which is emitted from the light source 4*b* of the LED bulb is reflected downward. As the metal foil, for example, gold foil, silver foil, etc. may be used. As the high light blocking paint, for example, a lacquer etc. may be used.

Figure 9:
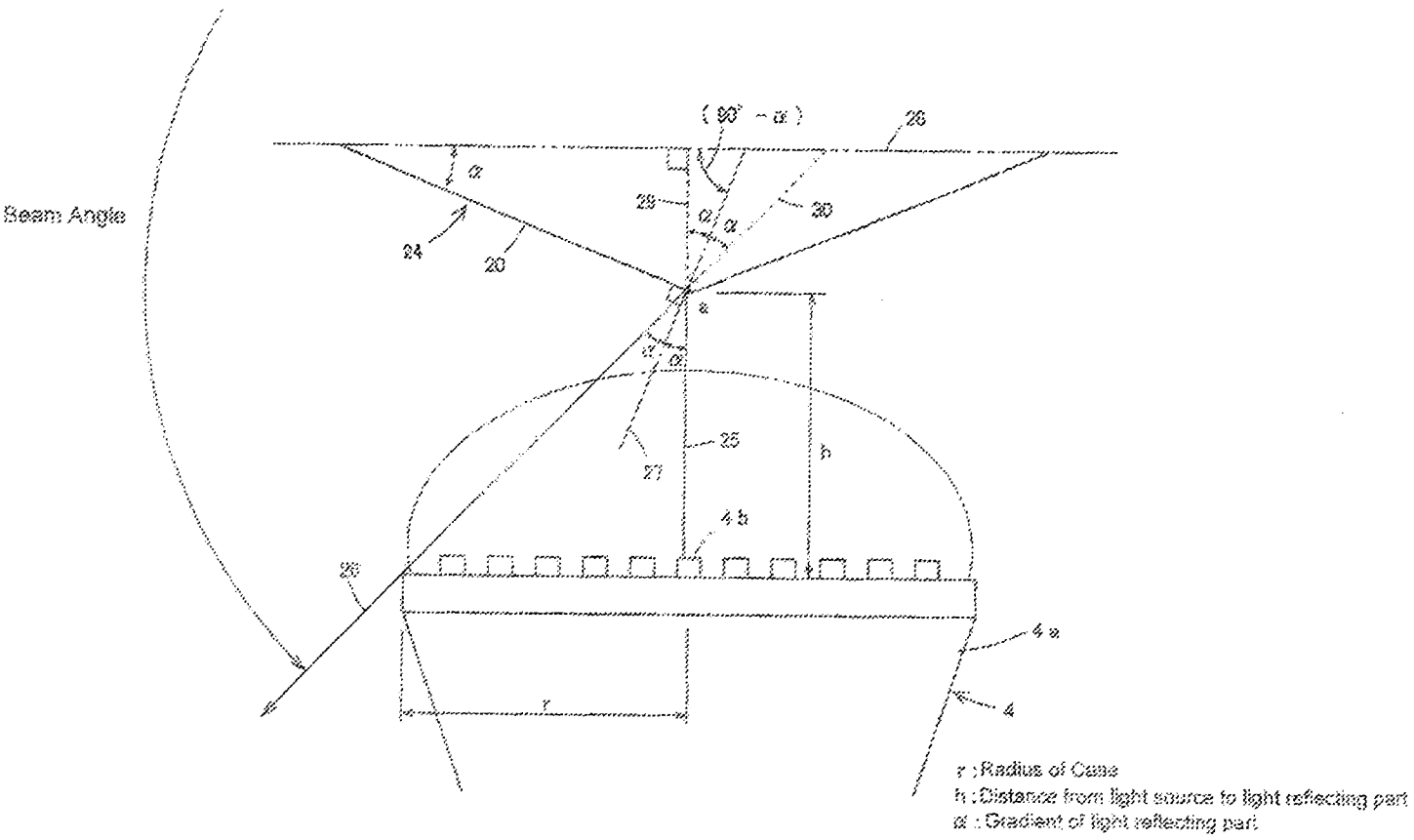
FIG. 9 is a model drawing which shows the state of reflection of light at the illumination tool.

The illumination tool is designed to satisfy the relationship of $r/h \approx \tan 2\alpha$ where the radius of the case 4*a* of the LED bulb 4 is "r", the distance from the light source (LED chip) 4*b* of the LED bulb 4 to the bottom part 20 of the main body 1 (light reflecting part 24) is "h", and the gradient of the bottom part 20 of the main body 1 (light reflecting part 24) is "α". The reason will be explained based on FIG. 9. To increase the beam angle, it is sufficient to make the gradient α of the bottom part 20 smaller, but if the light which is reflected at the bottom part 20 strikes the case 4*a* of the LED bulb 4, light energy is lost. To make the beam angle maximum and greatly reduce the loss of light energy, as shown in FIG. 9, it is sufficient that the light 25 which is emitted from the center part of the LED bulb 4 be reflected at the bottom part 20 and the reflected light 26 exit to the outside of the radius "r" of the case 4*a* of the LED bulb 4. At this time, the point at which the light is reflected is defined as "α" and the angle which is formed by the vertical 27 which is drawn from the point "α" and the horizontal 28 becomes (90°−α), so the angle which is formed by the extension 29 of the incident light 25 and the vertical 27 becomes α. The angle which is formed by the extension 30 of the reflected light 26 and the vertical 27 also becomes α. The angle between the incident light 25 and the reflected light 26 corresponds to the diagonal of these angles, so becomes 2α. Accordingly, the relationship of $r/h=\tan 2\alpha$ stands. The beam angle at this time is $\{90°+(90°-2\alpha)\}\times 2$, so 360°−4α. Specifically, if using an E17 size LED bulb 4, the radius "r" of the case 4*a* becomes 17.5 mm, so for example if making "h" 30.3 mm, from the relationship of $r/h=\tan 2\alpha$, the gradient α of the bottom part 20 becomes 15°. The beam angle at this time becomes 300° from 360°−4α. The beam angle of the LED bulb 4 itself becomes 115°, so compared with this, it is understood that the beam angle greatly expands.

The gradient α of the bottom part 20 of the main body 1 is set so that the relationship of $r/h=\tan 2\alpha$ stands at the center part. The part at the outer circumferential side can be made a gradient leveler than this. For example, in the above specific example, it is possible to make the gradient α of the center part of the bottom part 15° and make the gradient α of the part at the outer circumferential side a leveler gradient (for example, 5° to 10°. By doing this, it is possible to greatly increase the beam angle.

As explained above, the illumination tool is provided with the light reflecting part 24 which is inclined so as to approach the light source 4*b* of the LED bulb the more toward the center at the bottom part 20 of the main body 1 so as to set the LED bulb 4 to face upward while lighting from below. This is suitable as outdoor or indoor lighting. Furthermore, by satisfying the relationship of $r/h \approx \tan 2\alpha$ between the radius "r" of the case 4*a* of the LED bulb 4, the distance "h" from the light source 4*b* of the LED bulb 4 to the bottom part 20 of the main body 1, and the gradient α of the bottom part 20 of the main body 1, the light which is emitted from the center part of the LED bulb 4 is reflected to exit to the outside of the case 4*a* of the LED bulb 4, so it is possible to efficiently light up the bottom or sides without loss of light energy and possible to make the beam angle maximum. The light reflecting part 24 is formed by attaching metal foil or high light blocking paint 22 on the surface of the bottom part 20 of the glass main body 1, so the bottom part 20 of the main body 1 reflects light well like a mirror. Further, the main body 1 is closed by closing the opening part 1*a* by the lid 2, so the inside surface is prevented from becoming dirty and the mirror effect can be maintained semipermanently. Further, patterns 23 are formed by the metal foil or high light blocking paint 22, so the patterns 23 can be enjoyed as a design image when turned off. Light passes from the parts of the bottom part 20 where no metal foil or high light blocking paint 22 is attached, so the upward part can also be lighted up and the patterns 23 can be projected on the ceiling etc. Furthermore, by providing the taper part 21 with a diameter which becomes smaller the further toward the bottom part side at the side walls of the main body 1, the light which is emitted from the LED bulb 4 is refracted and reflected at and passes through the taper part 21, so the surroundings become brighter. Furthermore, the illumination tool is arranged with the LED bulb 4 facing upward, so can be easily set on the support 19 etc. The wiring also becomes easy.

Figure 10:
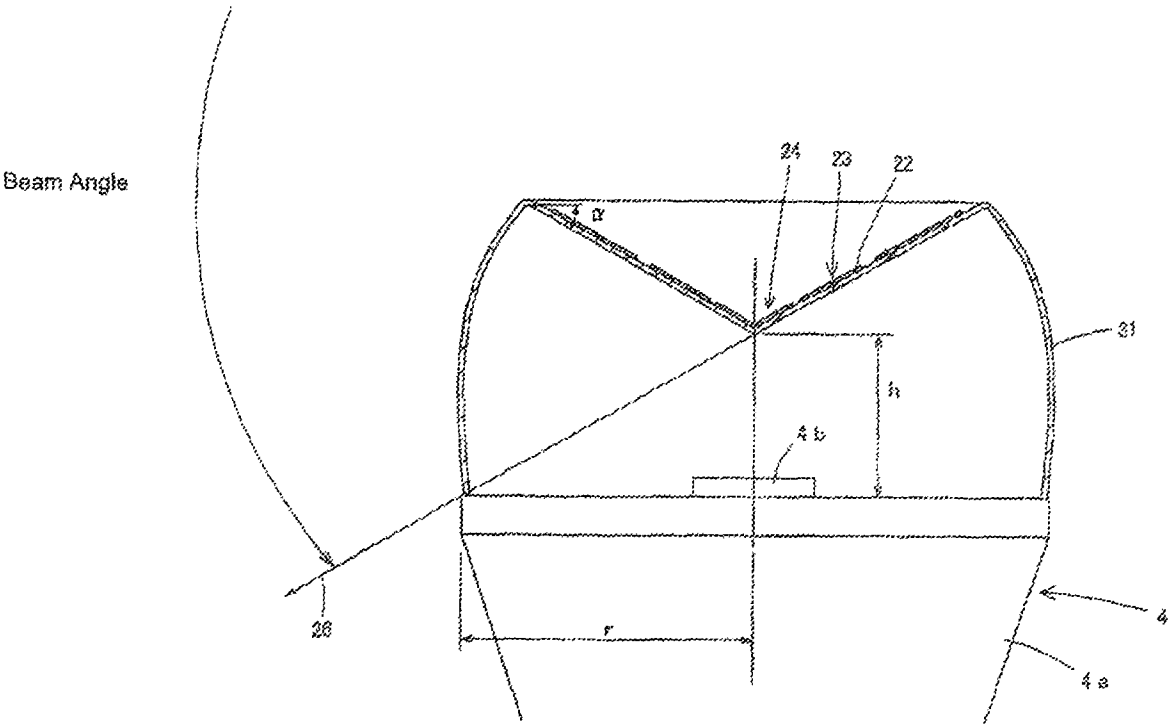
FIG. 10 is a longitudinal cross-sectional view which shows a fourth embodiment of the illumination tool of the present invention.

The above-mentioned light reflecting part 24, as shown in FIG. 10, can be provided at the glass cover 31 which is provided at the top part of the LED bulb 4 (fourth embodiment). The illumination tool of the present embodiment satisfies the relationship of $r/h \approx \tan 2\alpha$ where the radius of the case 4*a* of the LED bulb 4 is "r", the distance from the LED light source 4*b* to the light reflecting part 24 is "h", and the gradient of the light reflecting part 24 is "α". Even if formed in this way, the light which is emitted from the LED light source 4*b* is reflected by the light reflecting part 24 so as to exit to the outside of the case 4*a* of the LED bulb 4, so can efficiently light up the bottom or sides without loss of light energy and the beam angle can be made maximum.

Figure 11A:
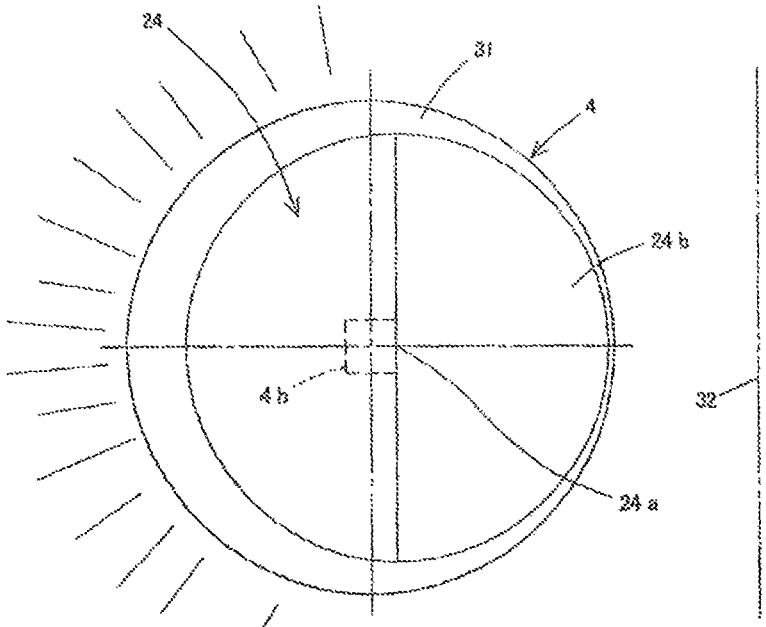
FIGS. 11(*a*), 11(*b*) are a plan view and a longitudinal cross-sectional view showing a modification of the illumination tool of the fourth embodiment.
Figure 11B:
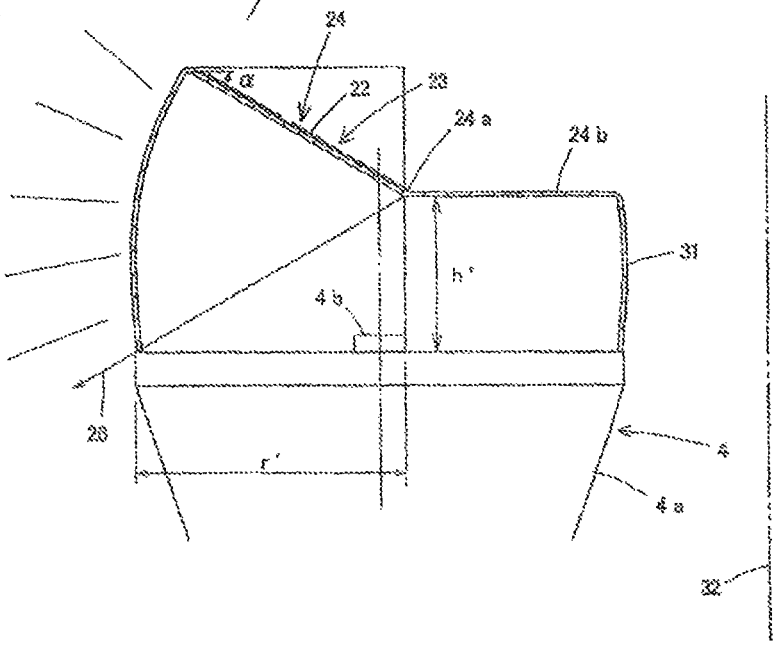
Figure 12:
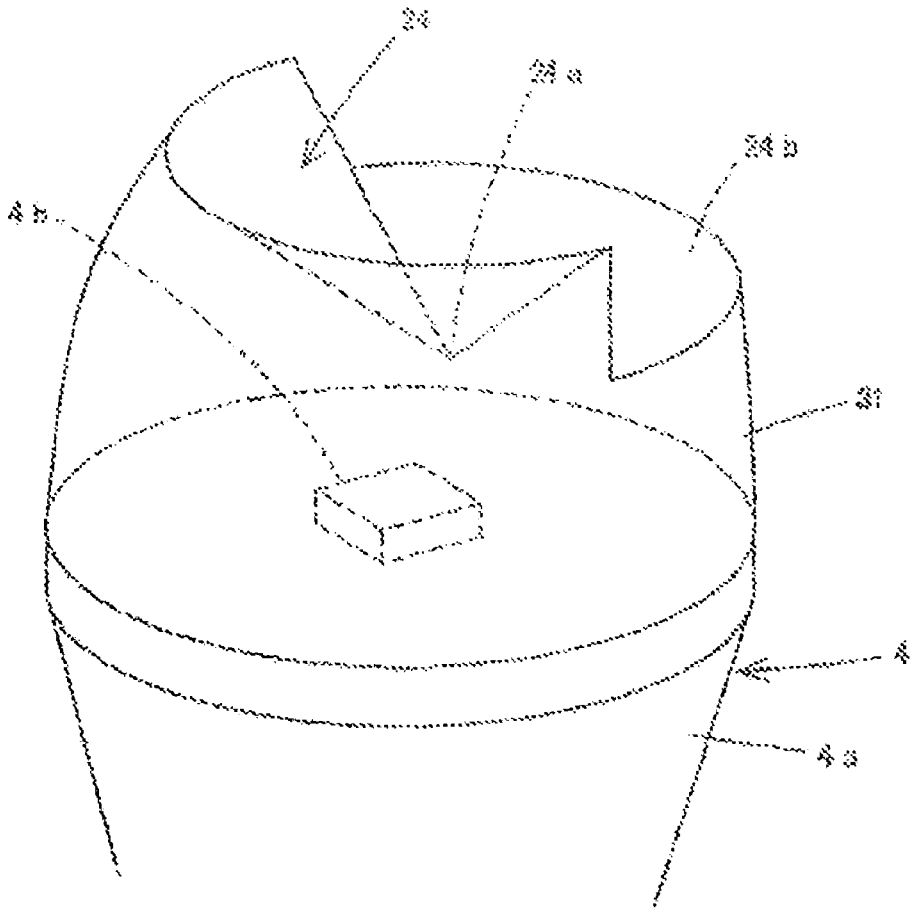
FIG. 12 is a perspective view of the illumination tool.

FIGS. 11(*a*), 11(*b*) and 12 show a modification of the illumination tool of the above fourth embodiment. In this example, the glass cover 31 which is attached to the top part of the LED bulb 4 has a light reflecting part 24. The light reflecting part 24 forms a conical shape surface which is inclined so as to approach the LED light source 4*b* more the further toward the center 24*a*. The center 24*a* of the light reflecting part is arranged at a position offset to the right from the center of the case 4*a* of the LED bulb 4. The part 24*b* at the right side from the light reflecting part 24 of the glass cover 24 may also be a conical shape surface in the same way as the light reflecting part 24, but does not face the LED light source 4*b*, so becomes a flat surface. Note that, while the illustration is omitted in FIG. 11(*a*) and FIG. 12, the surface of the light reflecting part 24 is provided with metal foil or high light blocking paint 22 to thereby form suitable patterns 23. The LED light source 4*b* is arranged at the center of the case 4*a*, so the center 24*a* of the light reflecting part is offset to the right side from the center of the LED light source 4*b*. The illumination tool of the present embodiment satisfies the relationship of r'/h'=tan 2α where the distance from the LED light source 4*b* to the edge of the case 4*a* (external dimension) is r', the distance from the LED light source 4*b* to the light reflecting part 24 is h', and the gradient of the light reflecting part is α. The illumination tool is arranged with the center 24*a* of the light reflecting part offset from the center of the LED light source 4*b* so light can be reflected and dispersed at part of the region at the circumference of the LED bulb 4 (in the illustration, the left half region). Therefore, when providing it near the wall 32 etc., it is possible to brightly light up the opposite side of the wall 32 etc. Further, by satisfying the relationship of r'/h'=tan 2α, the light which is emitted from the LED light source 4*b* is reflected by the light reflecting part 24 so as to exit to the outside of the case 4*a* of the LED bulb 4, so it is possible to efficiently light up the bottom or sides without loss of light energy and possible to effectively utilize light even if the amount of light of the LED light source 4*b* is small.

Figure 13A:
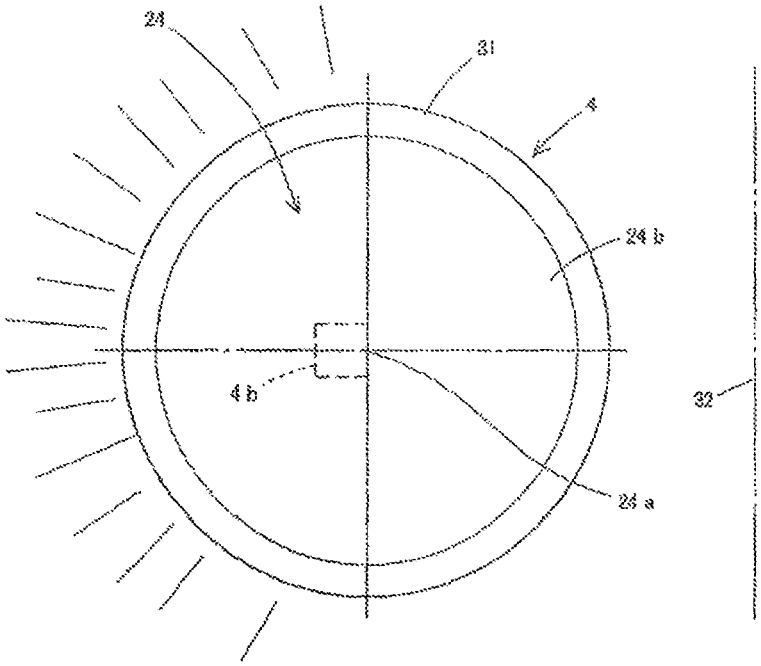
FIGS. 13(*a*), 13(*b*) are a plan view and a longitudinal cross-sectional view showing another modification of the illumination tool of the fourth embodiment.
Figure 13B:
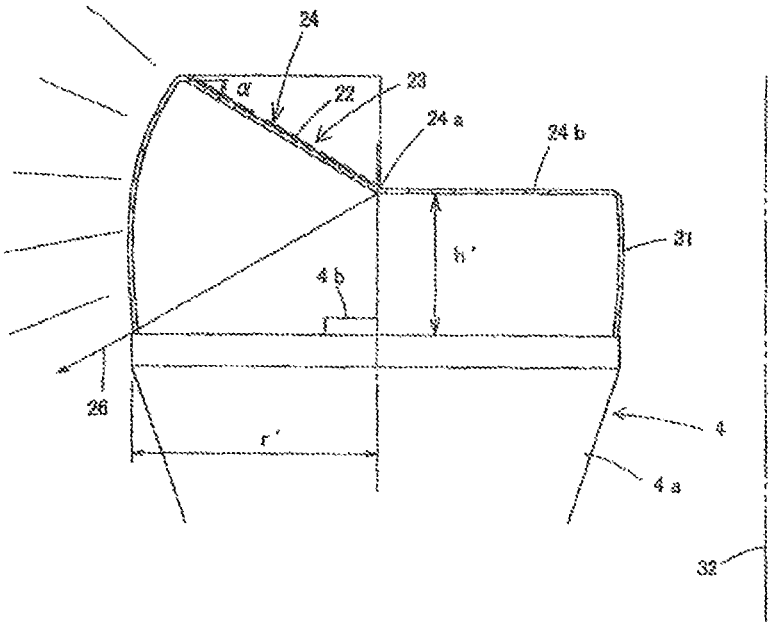

FIGS. 13(*a*), 13(*b*) show another modification of the illumination tool 1 of the fourth embodiment. In this example, the light reflecting part 24 is provided with a center 24*a* matching the center of the case 4*a* of the LED bulb 4, and the LED light source 4*b* is arranged offset from the center of the case 4*a* of the LED bulb 4. The illumination tool also, in the same way as the one of FIGS. 11(*a*), 11(*b*), reflects and disperses much light to part of the region in the surroundings of the LED bulb 4 (in illustration, left side region) and can efficiently utilize the light of the LED light source 4*b*.

Figure 14:
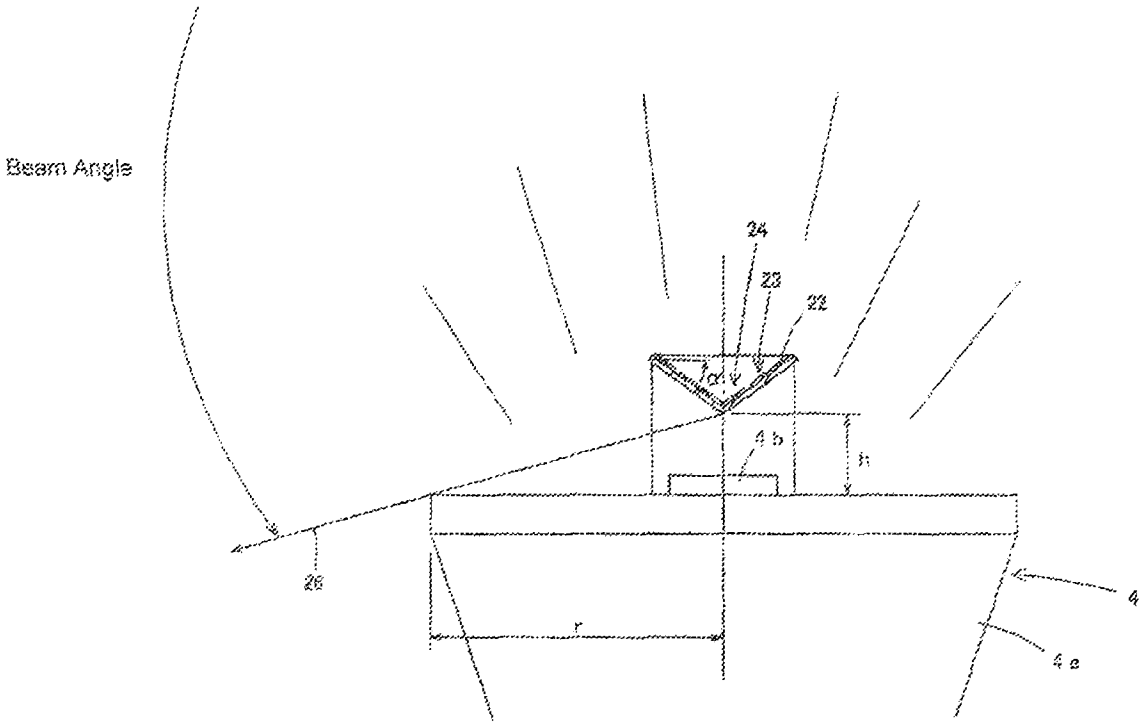
FIG. 14 is a longitudinal cross-sectional view which shows a fifth embodiment of the illumination tool of the present invention.
Figure 15:
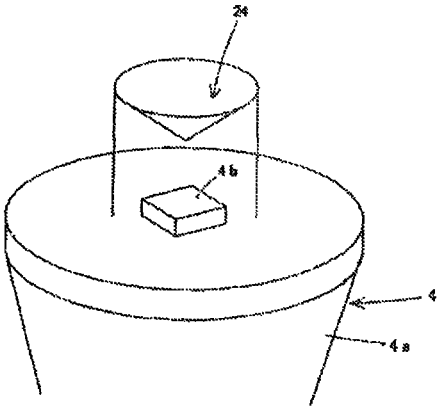
FIG. 15 is a perspective view of the illumination tool.

Further, the light reflecting part 24, as shown in FIGS. 14 and 15, can also be provided on the case 4*a* of the LED bulb 4 (fifth embodiment). The illumination tool of the present embodiment is made to satisfy the relationship of r/h≈ tan 2α if defining the radius of the case 4*a* of the LED bulb 4 as "r", the distance from the LED light source 4*b* to the light reflecting part 24 as "h", and the gradient of the light reflecting part 24 as "α". Even if formed in this way, the light which is emitted from the LED light source 4*b* is reflected by the light reflecting part 24 so as to exit to the outside of the case 4*a* of the LED bulb 4, so the bottom and sides can be efficiently lighted up without loss of light energy and the beam angle can be made maximum.

Figure 16A:
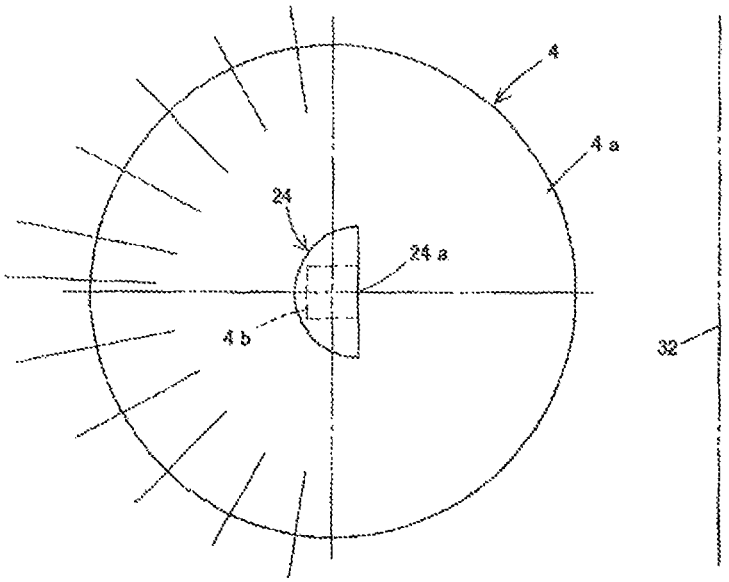
FIGS. 16(*a*), 16(*b*) are a plan view and a longitudinal cross-sectional view showing a modification of the illumination tool of the fifth embodiment.
Figure 16B:
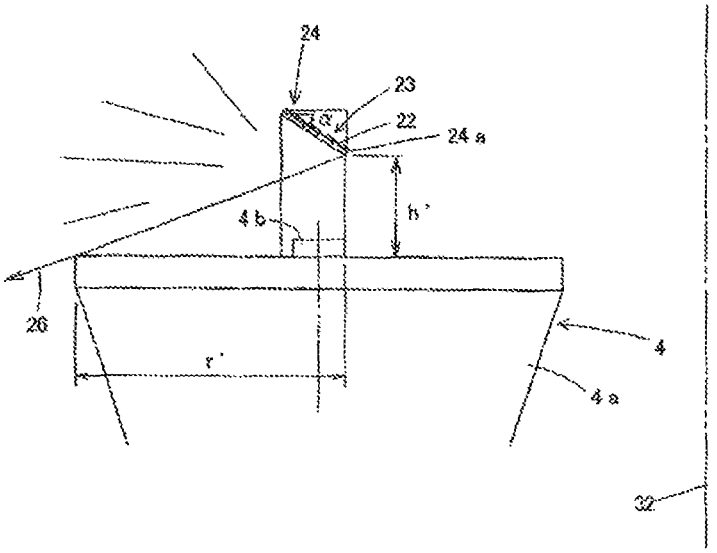
Figure 17:
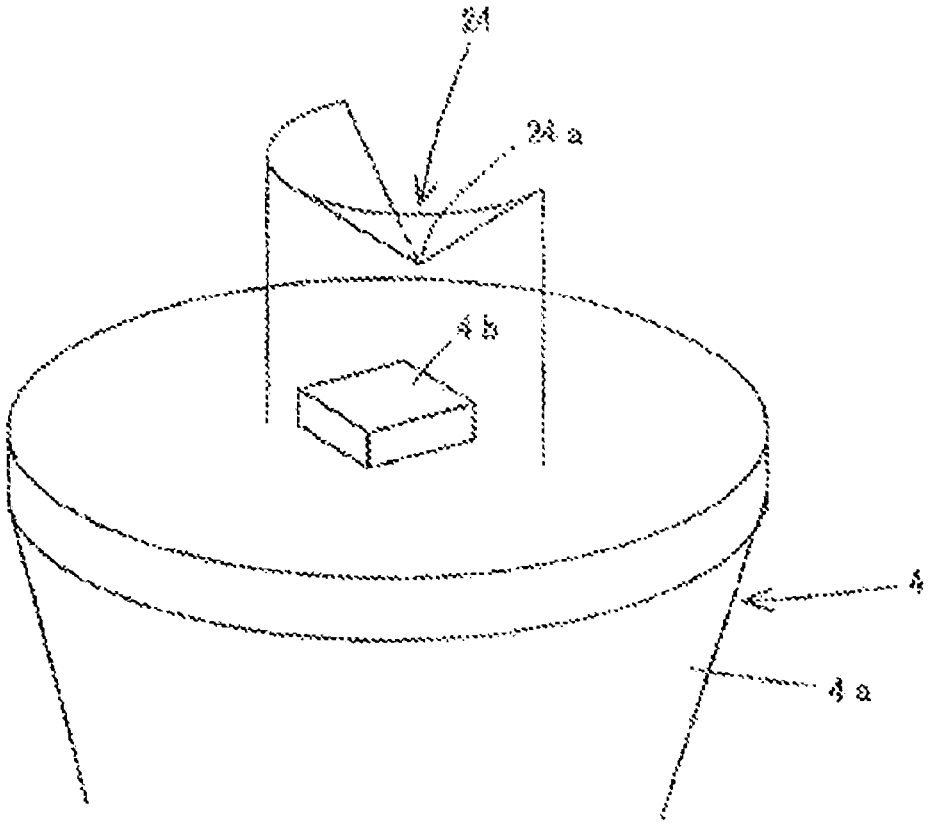
FIG. 17 is a perspective view of the illumination tool.

FIGS. 16(*a*), 16(*b*) and 17 show a modification of the illumination tool of the fifth embodiment. The light reflecting part 24 forms a conical shaped surface which is inclined to become closer to the LED light source 4*b* the more toward the center 24*a*, the center 24*a* of the light reflecting part is arranged at a position which is offset to the right side from the center of the case 4*a* of the LED bulb 4, and the right half of the cone is eliminated so as not to face the LED light source 4*b*. Note that, in FIG. 16(*a*) and FIG. 17, illustration is omitted, but the surface of the light reflecting part 24 is provided with metal foil or high light blocking paint 22 and thereby a suitable pattern 23 is formed. The LED light source 4*b* is arranged at the center of the case 4*a* and therefore the center 24*a* of the light reflecting part is offset to the right side from the center of the LED light source 4*b*. The illumination tool of the present embodiment satisfies the relationship of r'/h'=tan 2α when the distance from the LED light source 4*b* to the edge of the case 4*a* (outside diameter) is "r'", the distance from the LED light source 4*b* to the light reflecting part 24 is "h'", and the gradient of the light reflecting part is α. The illumination tool is arranged with the center 24*a* of the light reflecting part offset with respect to the center of the LED light source 4*b* so more light can be reflected and dispersed at the region of part of the surroundings of the LED bulb 4 (in the illustration, the left half region). Therefore, when set close to the wall 32 etc., the reflection side of the wall 32 etc. can be brightly lit up. Further, by satisfying r'/h'=tan 2α, the light which is emitted from the LED light source 4*b* is reflected by the light reflecting part 24 to the outside of the case 4*a* of the LED bulb 4, so the bottom or sides are efficiently lighted up without loss of light energy.

Figure 18A:
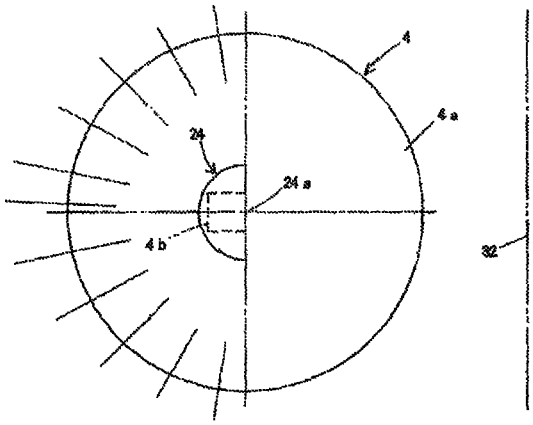
FIGS. 18(*a*), 18(*b*) is a plan view and a longitudinal cross-sectional view showing another modification of the illumination tool of the fifth embodiment.
Figure 18B:
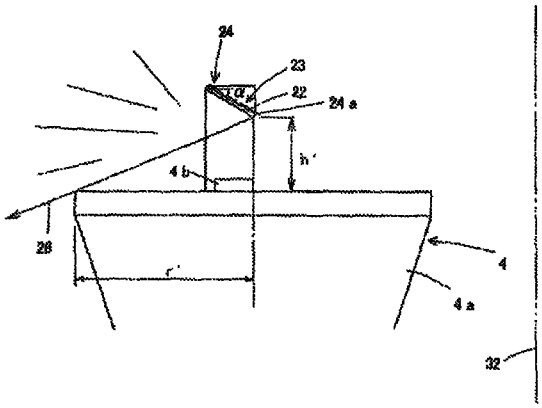

FIGS. 18(*a*), 18(*b*) show another modification of the fifth embodiment. In this example, the light reflecting part 24 is provided so that its center 24*a* matches the center of the case 4*a* of the LED bulb 4 and the LED light source 4*b* is arranged offset from the center of the case 4*a* of the LED bulb 4. The illumination tool, like the one of FIG. 16, reflects and disperses light more to part of the region in the surroundings of the LED bulbs 4 (in the illustration, region of left half) and can efficiently use the light of the LED light source 4*b*.

The present invention is not limited to the embodiments which were explained above. The shapes and materials of the main body and lid may be suitably changed.

REFERENCE SIGNS LIST

1 main body
1*a* opening part
2 lid
2*a* inner lid
2*b* outer lid
3 socket
4 LED bulb
4*a* case
4*b* LED light source
12 desiccant
16 groove (light dispersing treatment)
17 heat radiating plate
18 pattern
20 bottom part of main by (light reflecting part)
21 taper part
22 metal foil or high light blocking paint
23 pattern
24 light reflecting part
"r" radius of case 4*a*
"h" distance from light source to bottom part of main body (distance from LED light source to light reflecting part)
α gradient of bottom part (gradient of light reflecting part)

What is claimed is:

1. An LED bulb, comprising:

a case having a radius defined as r;

an LED light source set on the case; and a cover arranged on the case to cover the light source therein, and including a side portion and a top portion forming a light reflecting part thereon, the light reflecting part being arranged apart from the LED light source is by a distance defined as h to form a space therebetween and having a slant so as to approach the LED light source toward a center thereof to have a horizontal gradient defined as α, wherein a relationship of r, h and α is r/h≈ tan 2α to efficiently light up a bottom and sides of the LED bulb without loss of a light energy.

2. The LED bulb according to claim 1, wherein the top portion of the cover includes a glass surface, and the light reflecting part is a metal foil or high light blocking paint formed on the glass surface.

3. The LED bulb according to claim 2, wherein the light reflecting part has a pattern of the metal foil or high light blocking paint.

4. The LED bulb according to claim 1, wherein the top portion is formed in an inverse conical shape having an apex positioned closest to the LED source, and the light reflecting part is formed on a part of the top portion of the cover to reflect a light from the LED light source, and a remaining part of the top portion other than the part of the top portion is formed to transmit the light from the LED light source therethrough.

5. An illumination device comprising:

an LED bulb including a case having a radius defined as r, an LED light source set on the case, and a cover arranged on the case to cover the light source therein;

a main body formed in a closed bottom tubular shape to have an opening part at one end thereof through which the LED bulb is inserted, and having a light transmitting ability, the main body including a light reflecting part formed at a closed bottom part above the LED bulb to reflect a light of the LED bulb and arranged apart from the LED light source by a distance defined as h to form a space therebetween, the light reflecting part including a slant to approach the LED light source toward a center thereof to have a horizontal gradient defined as $\alpha$; and a lid closing the opening part of the main body to house the LED bulb with the main body, wherein a relationship of r, h and $\alpha$ is $r/h \approx \tan 2\alpha$ to efficiently light up a bottom and sides of the illumination device without loss of a light energy.

6. The illumination device according to claim 5, wherein the main body has a first side wall portion tapered such that a diameter becomes smaller toward the closed bottom part thereof.

7. The illumination device according to claim 6, wherein the main body further includes an engaging portion formed at one end portion thereof to engage the lid, and a second side wall portion formed between the first side wall portion and the engaging portion and tapered such that the diameter becomes larger toward the first side wall portion from the engaging portion.

8. The illumination device according to claim 5, wherein the closed bottom part of the main body is formed in an inverse conical shape having an apex positioned closest to the LED source, and the light reflecting part is formed on a part of the closed bottom part of the main body to reflect a light from the LED light source, and a remaining part of the closed bottom part other than the part of the closed bottom part is formed to transmit the light from the LED light source therethrough.

9. An LED bulb, comprising:

a case;

an LED light source set on the case; and a cover arranged on the case to cover the light source therein, and including a side portion and a top portion forming the light reflecting part thereon, the light reflecting part having a center arranged with an offset from a center of the LED light source to have a distance defined as r' from an outer edge of the case to the center of the light reflecting part in a horizontal direction, the light reflecting part being arranged apart from the LED light source by a distance defined as h' to form a space therebetween and having a slant so as to approach the LED light source toward the center of the LED reflecting part to have a horizontal gradient defined as $\alpha$, wherein a relationship of r', h' and $\alpha$ is $r'/h' \approx \tan 2\alpha$ to efficiently light up a bottom and sides of the LED bulb without loss of a light energy.

10. The LED bulb according to claim 9, wherein the top portion includes a first portion with a flat surface and a second portion adjacent to the first portion, the second portion having an inverse conical shape cut in half along an axis thereof having an apex positioned closest to the LED source, and the light reflecting part is formed on a part of the top portion formed in the second portion to reflect a light from the LED light source, and a remaining part of the top portion other than the reflecting part, and the first portion are formed to transmit the light from the LED light source therethrough.

11. The LED bulb according to claim 10, wherein the LED light source is arranged only on the case below the top portion formed in the half inverse conical shape.

12. The LED bulb according to claim 9, wherein the center of the light reflecting part is positioned to vertically align with a side surface of the LED light source arranged away from the outer edge of the case so that a distance from the outer edge of the case to the side surface of the LED light source has a length same to the distance defined as r'.

* * * * *